United States Patent [19]

Labas

[11] Patent Number: 4,740,155

[45] Date of Patent: Apr. 26, 1988

[54] DUAL DAMPER HEAT CONTROL FURNACE

[75] Inventor: Nicholas Labas, Solon, Ohio

[73] Assignee: ELTECH Systems Corporation, Boca Raton, Fla.

[21] Appl. No.: 81,784

[22] Filed: Aug. 5, 1987

[51] Int. Cl.[4] ..... F27D 1/00

[52] U.S. Cl. ..... 432/247; 52/86; 110/331; 110/334; 110/336

[58] Field of Search ..... 52/86, 11, 245, 246, 52/639, 641; 110/331, 334, 336; 432/247

[56] References Cited

U.S. PATENT DOCUMENTS 2,824,529 2/1958 Ries ..... 110/335 X 4,524,702 6/1985 Miller et al. ..... 110/331 X

*Primary Examiner*—Edward G. Favors

*Attorney, Agent, or Firm*—John J. Freer

[57] ABSTRACT

A furnace is now provided having a dual pressure damper control system. Such system provides for substantial flexibility of control over the flow of flue gases, and consequently leads to substantial flexibility in the economical treatment of work pieces from a relatively low to relatively high product throughput. Additionally, the furnace includes a lightweight, readily repairable and readily removable, cover member. Such provides for ease of repair of not only the cover member, but also the furnace generally. Dual dampers can be used in association with dual heat chambers and burners therefore providing additional operational efficiency.

15 Claims, 1 Drawing Sheet

DUAL DAMPER HEAT CONTROL FURNACE

BACKGROUND OF THE INVENTION

It has been known to construct a furnace such as a pusher furnace, useful for the heat treatment of metal work pieces proceeding through the furnace, with a flue for offgases located adjacent the charge end. As the workpieces proceed through the furnace from underneath the flue, they travel through a restricted, or throat section of the furnace, to a heat chamber. At the far end of the heat chamber, the heated workpieces are discharged from the furnace.

It has been possible to construct the roof and wall sections of such furnaces of ceramic fiber to enhance the insulation characteristics of such surfaces. Typical construction for these structures has been shown for example in U.S. Pat. No. 4,411,621.

Although such furnaces can provide for economical insulation as well as efficient workpiece heat treatment, even for a somewhat varied workpiece charge rate, where a more extended variation in rate is desired, or even where product interruption can occur, such furnaces tend to be uneconomical. Although positioning a recuperator at the flue outlet will assist in initial economy of operation, recuperator maintenance can diminish overall achieved economy.

It would therefore be desirable to construct a furnace operating most efficiently not only over a wide range of workpiece throughput but also providing economy of maintenance during product interruption. It would also be desirable to construct such a furnace, e.g., a pusher furnace, that can maintain the worthwhile insulation features afforded by the use of ceramic fiber insulation.

SUMMARY OF THE INVENTION

A furnace has now been constructed, such as of the pusher furnace type, which provides enhanced flexibility in heat control, including obtaining desired heating without overheating. Enhanced energy control is now achieved over a wide range of workpiece throughput. Additionally the present invention provides for a lightweight furnace cover which can be readily inserted onto the furnace, or easily removed. This feature thus provides not only ease of repair for the cover, but also for the furnace generally. The unique cover structure of the present invention utilizes the desirable ceramic fiber construction. It is also contemplated that the cover design can offer revserible positioning.

Broadly, the present invention is directed to a furnace adapted for economical and flexible workpiece throughput, such furnace comprising a hearth member extending at least substantially along the full length of the furnace, an at least substantially gull-wing-shaped, readily-removable roof member extending above the hearth member from a first flue means to a second flue means, a first heat zone beneath a first wing section of the roof member, such first heat zone having a first heater element, a first flue means rising from the first heat zone, a first damper means on the first flue means, a second heat zone beneath a second wing section of the roof member, such second heat zone having a second heater element, a second flue means rising from the second heat zone; and a second damper means on the second flue means.

An additional aspect of the invention pertains to a lightweight furnace cover comprising an at least substantially gull-wing-shaped, readily-removable roof member.

DESCRIPTION OF THE PREFERRED EMBODIMENTS

Figures 1, 2, 2A:
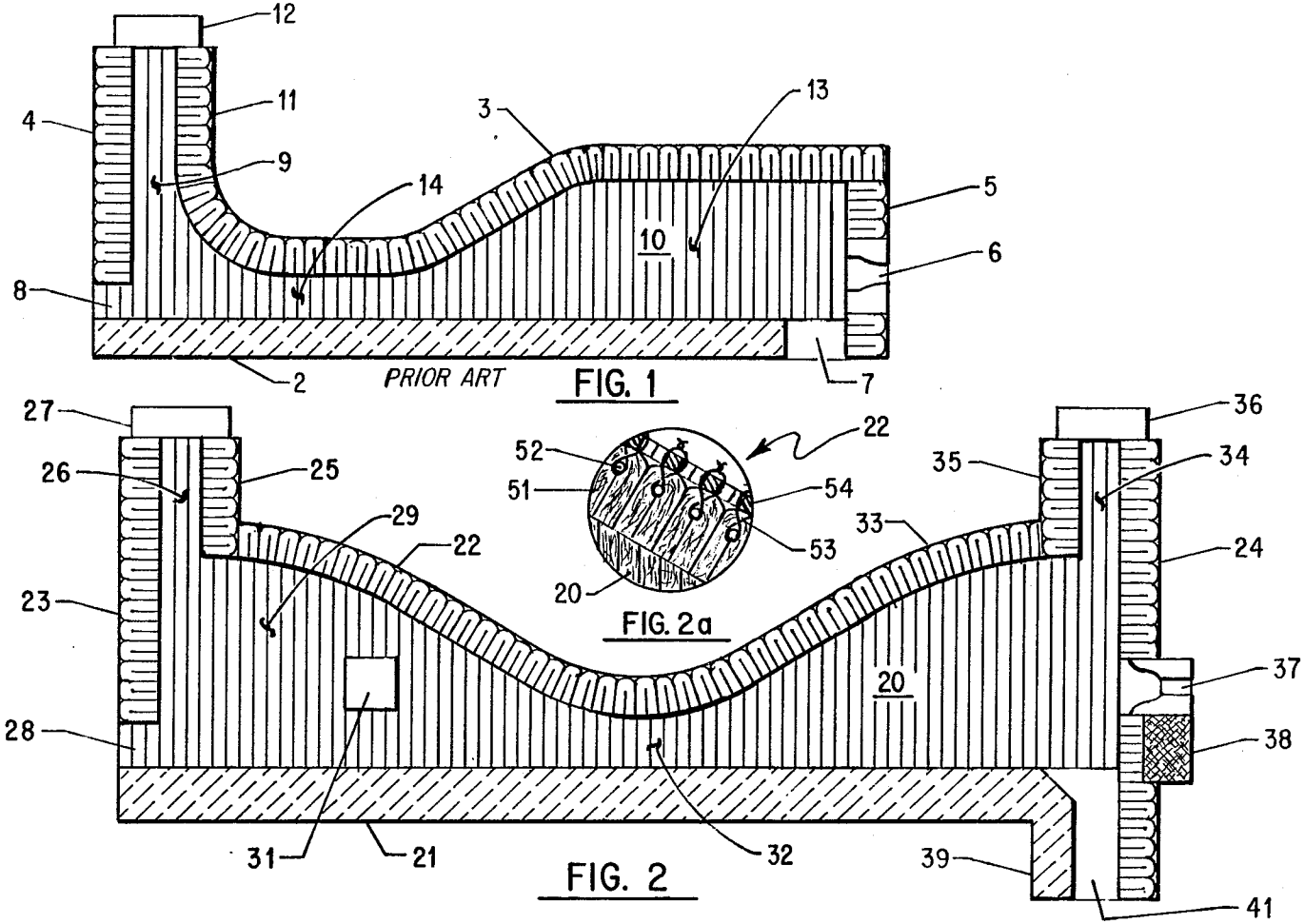
FIG. 1 PRIOR ART
FIG. 1 is a side elevational view in cross-section of a prior art furnace.
FIG. 2 is a side elevational view in cross-section of a dual damper furnace of the present invention.
FIG. 2*a* is a magnified view of the ceramic fiber lining and fiber support structure for the furnace roof of FIG. 2.

Single flue furnaces where articles proceed through the furnace can be useful for the heat treatment of metal workpieces, such as for the treatment of small steel articles to provide ductility and toughness. Such a prior art single flue furnace, an example of which can be referred to as a pusher furnace, has been shown in FIG. 1.

Referring more particularly to the Figure, the pusher furnace has a hearth 2, which provides the furnace floor, and is usually prepared from dense castible material. Spaced apart and above the hearth 2 is a furnace roof 3. In addition to the hearth 2 and the roof 3, the enclosure for the furnace is provided by a charge end front wall 4, discharge end back wall 5, far side wall 10 and foreground wall (not shown). The insulation for the roof 3, front and back walls 4,5, as well as for the side walls 10 is provided by folded blankets of ceramic fiber insulation filler. The discharge end back wall 5 can contain a heating element 6. An aperture provided between the hearth 2 and the discharge end back wall 5 serves as a workpiece discharge aperture 7. A workpiece charge aperture 8 is provided between the hearth 2 and the charge end front wall 4.

A flue 9 is located between the charge end front wall 4 and an upright section 11 of the roof 3. Atop the flue 9 is a recuperator 12 useful for circulating hot gases to the heating element 6. Gases from the heating element 6 feed into the heat chamber 13 and from there proceed through the furnace throat 14 and on out the flue 9.

When a furnace of the FIG. 1 prior art type is operated, as in continuous production, production may become interrupted with workpieces still within the furnace. The heating element 6 can still generate flue gases through the furnace throat 14 for heat maintenance. But the heating may readily elevate the workpieces to a higher than desired temperature, which can deleteriously affect the product, e.g., increased scale on steel articles. Moreover, when a prior art furnace of this FIG. 1 type is operational, the full hearth area is heated even when it is attempted to minimize the heating for the furnace throat 14, as during reduced product throughput.

Referring then to FIG. 2, a pusher type furnace of the present invention is shown having a hearth 21 and spaced apart and above therefrom an at least substantially gull-wing-shaped roof 22. The materials of construction for the hearth 21 and the roof 22 can be as described hereinabove. Completing the housing of the furnace as depicted in the Figure, the furnace has a charge end front wall 23, a discharge end back wall 24, a far side wall 20 and a foreground side wall (not shown). The charge end front wall 23, coupled with a first upright roof section 25 form a first flue 26. Atop the first flue 26 is a first flue damper 27. Between the low end of the charge end front wall 23 and the hearth 21 is a workpiece charge aperture 28. The workpieces, not shown, entering through this aperture 28 feed into the first heat zone 29 containing a heating element 31.

As workpieces proceed from the first heat zone 29, they pass through a furnace throat 32 positioned between the hearth 21 and the closest adjacent section of the roof 22. The workpieces then proceed into a second heat zone 33. Hot gases exiting from this second heat zone 33 can be at least partially discharged through a second flue 34 positioned between the discharge end back wall 24 and a second upright roof section 35. Atop the second flue 34 is a second flue damper 36. Positioned in the discharge end back wall 24 is a heating element 37 sitting partially atop a castible support block 38. The hearth 21 then terminates in a downwardly extending curb 39. Between this curb 39 and the discharge end back wall 24 is the workpiece discharge aperture 41.

In FIG. *2a* a section of the roof 22 is shown to have ceramic fiber blankets 51 supported by interengagement with rods 52 at the blanket folds. From the rods 52, tie wires 53 connect to a foraminous metal support member 54. The tie wires 53 pass from the rods 52, through folds in the blankets 51, to reach the foraminous metal support member 54. A perimeter blanket, not shown, can be used between the blankets 51 and the foraminous metal support member 54 to provide an extra layer of ceramic fiber insulation, if desired. Below and beyond the blankets 51 is the furnace far side wall 20. The foraminous metal support member 54 is further supported by a metal frame member, not shown.

It will be understood that in addition to the heating element 37 for the second heat zone 33, there can be a series of heating elements 37 positioned in the discharge end back wall 24. Additionally, heating elements positioned in the sidewalls may be useful. Moreover, the heating element 31 in the far side wall 20 of the first heat zone 29 can have a comparable heating element in the near foreground side wall, not shown, that has been removed for purposes of the figure to expose the zone 29. The hearth 21 will most always be provided by a hard densible substance such as a brick, castible or rammable plastic material. The hearth 21 may be provided in layers, with lower layers being of a less dense castible material and an upper wear layer of a wear tile.

For all wall construction, it is preferred that there be used ceramic fiber insulation. Such insulation can be most usefully employed as folded blankets. Support structure for such folded blanket roof and wall construction can be foraminous metal, e.g., metal mesh, with there being additional support members, e.g., metal channels, used for support of the foraminous metal. For convenience, individual ceramic fiber insulating units will generally be referred to herein as "blankets". By use of the term ceramic fiber "module", reference is being made to a unit of interengaged blankets, such as prepared by stitching together adjacent blankets or by interengaging such blankets by inner support means. The ceramic fiber insulation filler is composed primarily of elongated and folded, typically U-shaped, B-shaped, W-shaped or S-fold interlocked, ceramic fiber blankets. The blankets are in snug side-by-side relationship.

During roof and wall assembly, blankets can be snugly pressed against, and secured to, a foraminous metal sheet. The foraminous metal sheet to which the ceramic fiber insulation filler is secured is typically a sheet of expanded metal mesh, although other foraminous coverings are contemplated, e.g., a plate containing a multitude of holes. The securing means for connecting the insulation to the foraminous metal sheet may include any number of devices such as clips, J-shaped hooks, wire ties and the like. Support rods may be used in blanket folds and the connecting devices attached to these rods. Typical roof and wall construction of such supported ceramic fiber blankets has been shown for example in the U.S. Pat. No. 4,411,621 for the side walls and the U.S. Pat. No. 4,530,441 for similar roof construction.

It is a particular feature of the present invention that the roof 22 is not only therefore lightweight and readily insertable and removable, but is also insertable in the position as removed. Although usually the furnace throat 32 can be expected to be at least somewhat off center with respect to the overall cover length, it can be centrally located, as shown in FIG. 2. It is contemplated that for this variation, the roof may be removed, rotated 180 degrees and replaced. Furthermore, symmetry or near symmetry of the roof provides for ease of removal and replacement without undue swaying or swinging of the roof as may occur with the differing design prior art roof member of FIG. 1.

It is contemplated that all of the heating elements 37 will rest upon a dense burner support block 38 or the like. However, it is preferred that the facing of the block 38 be covered with a ceramic fiber facing, as has been shown in FIG. 2 for the heating element for the second heat zone 33. It is also contemplated that one or more of the dampers 27,36 may be replaced by recuperators. Usually, in operation, the workpiece charge aperture 28 will be sealed by a curtain of air blowing down the outer face of the charge end front wall 23 past the aperture 28. Furthermore, a slight positive air pressure will typically be employed at the workpiece discharge aperture 41 to prevent or retard the exiting of hot furnace gases from the second heat zone 33.

Considering a furnace having a hearth size as represented by a 10 foot linear length, the furnace of the present invention can have an efficient variation in the workpiece throughput from about 3000 pounds per hour to about 8000 pounds per hour. At comparable efficiences, for the same hearth size, the prior art pusher furnace of FIG. 1 can handle a variation in workpiece throughput of only about 6,000 pounds per hour to about 8,000 pounds per hour.

Although elements of the furnace, other than the ceramic fiber insulation filler and the hearth, have been generally referred to herein as metal elements, it will be appreciated that for certain structures lightweight ceramic materials may be suitable. However, the roof and walls are preferably free from the usual tile and refractory materials, e.g., bricks and other substantial ceramic materials, which are often found in heat insulating structures used in the metal heat treatment field. Furthermore, in addition to being tile-free and the like, the roof and walls should also be mortar-free for best economy.

I claim:

1. A furnace adapted for economical and flexible workpiece throughput, said furnace comprising:

a hearth member extending at least substantially along the full length of said furnace;

an at least substantally gull-wing-shaped, readily-removable roof member extending above said hearth member from a first flue means to a second flue means;

a first heat zone beneath a first wing section of said roof member, said first heat zone having at least one first heater element;

a first flue means rising from said first heat zone;

a first damper means on said first flue means;

a second heat zone beneath a second wing section of said roof member, said second heat zone having at least one second heater element;

a second flue means rising from said second heat zone; and a second damper means on said second flue means.

2. The furnace of claim 1, wherein said hearth comprises a hard densible material.

3. The furnace of claim 1, wherein said hearth extends from a furnace workpiece charge inlet to a furnace workpiece discharge outlet.

4. The furnace of claim 1, wherein said first heat zone comprises a front wall, side walls, hearth floor and first wing section roof member.

5. The furnace of claim 1, wherein said second heat zone comprises a back wall, side walls, hearth floor and second wing section roof member.

6. The furnace of claim 1, wherein said roof member and furnace walls comprise a multitude of ceramic fiber blankets fastened to a foraminous metal support member.

7. The furnace of claim 6, wherein said blankets are present as unit structures and said structures include individual, folded U-shaped, B-shaped, S-shaped or W-shaped units.

8. The furnace of claim 1, wherein both said first and second flue means comprise walls of ceramic fiber blankets.

9. The furnace of claim 1, wherein said first heat zone has at least one heater element in a heat zone side wall.

10. The furnace of claim 1, wherein said second heat zone has at least one heater element in a furnace back wall.

11. A lightweight furnace cover adapted for efficient furnace heat operation, said cover comprising an at least substantially gull-wing-shaped, readily-removable roof member prepared from a multitude of ceramic fiber blankets fastened to a foraminous metal support member, said roof providing a first wing section covering a first heat zone and a second wing section covering a second heat zone.

12. The furnace cover of claim 11, wherein said foraminous metal support member is attached to a metal frame member of said cover.

13. The furnace cover of claim 11, wherein said foraminous metal support member is a metal mesh.

14. The furnace of claim 11, wherein said blankets are present as unit structures and said structures include individual, folded U-shaped, B-shaped, S-shaped or W-shaped units.

15. The furnace cover of claim 11, wherein a first upright cover end section forms a portion of a first flue means for said furnace, and an opposite second upright cover end section forms a portion of a second flue means.

* * * * *